United States Patent [19]

Henderson

[11] Patent Number: 4,763,694

[45] Date of Patent: Aug. 16, 1988

[54] PARTICLE RETAINER CUP FOR RISER PIPES

[76] Inventor: Lillie M. Henderson, 347 W. 55th St., New York, N.Y. 10019

[21] Appl. No.: 90,607

[22] Filed: Aug. 28, 1987

[51] Int. Cl.[4] ..... F16L 55/07; F16L 55/24

[52] U.S. Cl. ..... 138/103; 138/128; 138/156; 138/167; 138/178; 126/317

[58] Field of Search ..... 138/103, 128, 156, 157, 138/159, 167, 171, DIG. 4, DIG. 10, DIG. 11, 177, 178; 137/375, 377, 378; 126/317; 52/317; 248/56, 57, 94

[56] References Cited

U.S. PATENT DOCUMENTS

| | | | |
|---|---|---|---|
| 135,170 | 1/1873 | Stephenson | 138/156 X |
| 505,459 | 9/1893 | Gothberg | 126/317 |
| 576,899 | 2/1897 | Scott | 126/317 |
| 1,175,770 | 3/1916 | Jones | 52/219 |
| 1,399,748 | 12/1921 | Cheney | 126/317 |
| 1,502,154 | 7/1924 | Mueller et al. | 126/317 |
| 2,594,843 | 4/1952 | Barfus | 126/317 |
| 2,681,057 | 6/1954 | George | 126/317 X |
| 3,500,480 | 3/1970 | Michal | 138/128 |

FOREIGN PATENT DOCUMENTS

| | | | |
|---|---|---|---|
| 336683 | 9/1919 | Fed. Rep. of Germany | 126/317 |
| 64415 | 3/1987 | Sweden | 126/317 |

*Primary Examiner*—James E. Bryant, III
*Attorney, Agent, or Firm*—Martin Smolowitz

[57] ABSTRACT

A unitary retainer cup adapted for being attached around a continuous vertical pipe so as to retain particulate materials in the cup. The cup has a lower cylindrical sleeve portion and a conical-shaped upper retainer portion including suitable clamp means which permits mating edges of a longitudinal joint in the cup to be retained together. The cup can be constructed of thin sheet material which is sufficiently flexible to permit it being placed around a pipe and clamped firmly onto the pipe. The lower sleeve portion is lined with a resilient material to accommodate irregularities in the surface of the pipe. The cup conical portion has a drain opening provided near its lower end to permit periodic removal of accumulated material from the cup.

10 Claims, 2 Drawing Sheets

FIG. 1
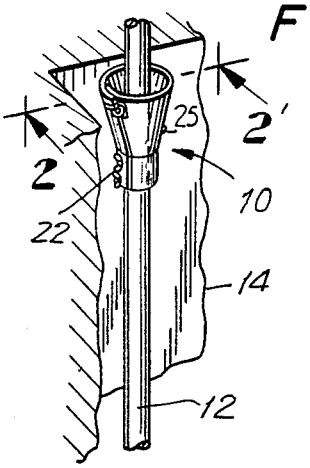
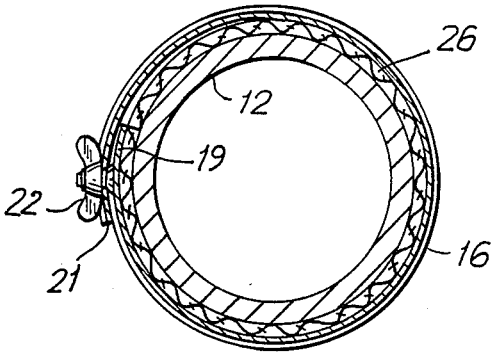
FIG. 3
FIG. 2
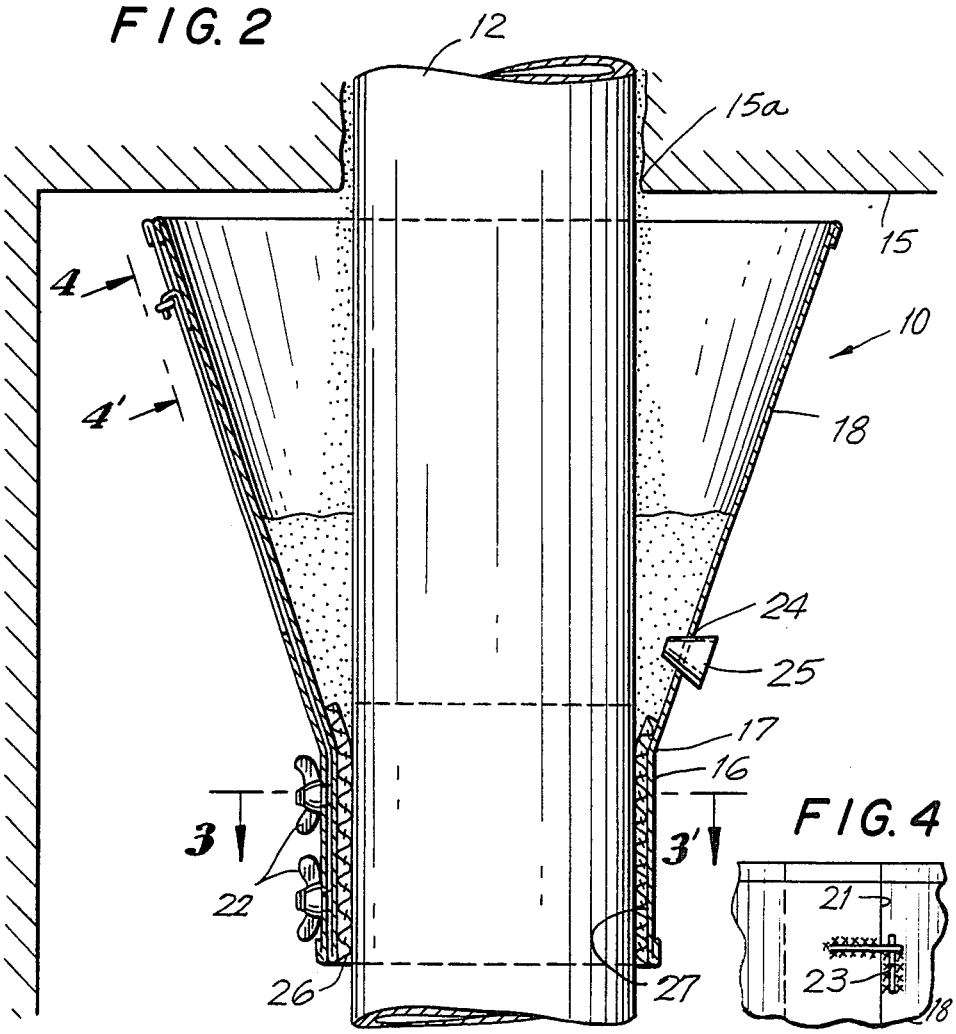
FIG. 4

PARTICLE RETAINER CUP FOR RISER PIPES

BACKGROUND OF INVENTION

This invention pertains to a retainer cup adapted for attachment around a continuous riser pipe for retaining particulate material collected from openings surrounding the pipe outer surface.

In many older residential building such as houses and apartment buildings, pipes and similar structures often extend vertically through an opening in a ceiling into a room or space above. Because such pipes often have an annular shaped opening through the ceiling around the pipe, particles such as dust and grit originating in the room or space above often pass through the opening into the room below. Such occurrences is quite undesirable for occupants of the lower room. To overcome this problem and prevent such particulate matter often caused by deterioration of the building from falling into a room containing such a riser pipe, a suitable baffle or retainer structure has been needed.

Various cup shaped structures for fitting around vertical pipes are known. For example, U.S. Pat. No. 1,399,748 to Cheney discloses a dustproof connection device for attachment to hot air furnace pipes below a floor of a dwelling. U.S. Pat. No. 2,581,992 to Wilder discloses a conical-shaped canopy for attachment to a smoke pipe upper end. U.S. Pat. No. 2,594,843 to Barfus discloses a canopy device for fitting around pipes adjacent a ceiling to close unsightly openings therein. Also, U.S. Pat. No. 2,681,057 to George discloses a water jacket for fitting around smoke pipes passing through the roof of a dwelling. However, none of these known prior art arrangements provide a retainer cup of unitary construction which can be conveniently slipped around and clamped onto a continuous vertical pipe, so as to retain particles such as dust and grit in the cup for subsequent periodic removal.

SUMMARY OF INVENTION

The present invention provides a retainer cup structure adapted for attachment around a continuous substantially vertical pipe or similar structure for retaining particulate matter. The cup is of unitary type construction and has a cylindrical shaped lower sleeve portion and a conical-shaped upper casing portion which are adapted to be slipped around a continuous pipe and attached onto the pipe by a tight fitting fastener arrangement. The cup has a single longitudinal joint extending along one side, and the mating edges of the joint are attached together by a plurality of suitable fasteners; to provide a cup which is able to be installed around a vertical pipe and collect and retain small particulate materials such as dirt and grit. The retainer cup also has a closable drain opening located near the lower end of the conical portion adjacent the sleeve. Thus, the cup never needs to be removed from around the pipe for cleaning, but instead the accumulated solid material can be conveniently removed at appropriate intervals by removing a plug and withdrawing the dirt out through the opening, such as by using a hose connected to a vacuum cleaner. The cup is usually attached around a vertical pipe at the lower sleeve portion and then slid up to near the ceiling of a room, with the cup upper end being about 1–2 inches below the ceiling. The cup lower cylindrical sleeve or portion is preferably lined with a layer of resilient material to facilitate sealing, such as felt about 0.050–0.100 inch thick.

The unitary retainer cup according to the present invention can be advantageously fitted around continuous substantially vertical pipes near the ceiling of a room by springing the cup edges apart at the vertical opening and slipping the cup around the pipe, and then clamping it in place. The cup will then collect any particulate material which may pass downwardly through an annular opening around the pipe and accumulate into the cup. After an appropriate period of time, the accumulated material in the cup can be conveniently and quickly removed through the plugged opening, such as by removing the plug and placing the vacuum cleaner hose over the opening and drawing out the collected material, after which the opening is reclosed.

Although the particle retainer cup is usually attached around pipes or other structures which extend substantially vertically through a ceiling opening, the cup can also be contoured and applied around pipes which extend through a ceiling opening at an angle up to about 45° with the vertical, and have the upper edge of the cup oriented substantially parallel to ceiling.

BRIEF DESCRIPTION OF DRAWINGS

The invention will be described further with reference to the following drawings, in which:

FIG. 1 shows a perspective view of the retainer cup installed around the upper portion of a riser pipe;

FIG. 2 shows a vertical cross-sectional view of the retainer cup taken along line 2—2' of FIG. 1;

FIG. 3 shows a horizontal cross-sectional view of the lower clamp portion of the cup taken at line 3—3' of FIG. 2;

FIG. 4 shows a side view of the cup upper portion fastening means taken from line 4—4' of FIG. 2.

DESCRIPTION OF INVENTION

As is generally shown by FIGS. 1–2, a retainer cup structure 10 is attached around the upper portion of a continuous vertical riser pipe 12 located within a room, usually near a wall 14 and with the enlarged upper end of the cup being located near ceiling 15 of the room. The cup accumulates dirt and grit materials which descend through a generally annular-shaped opening 15*a* located around pipe 12 from a space located above the room ceiling 15.

Figure 5:
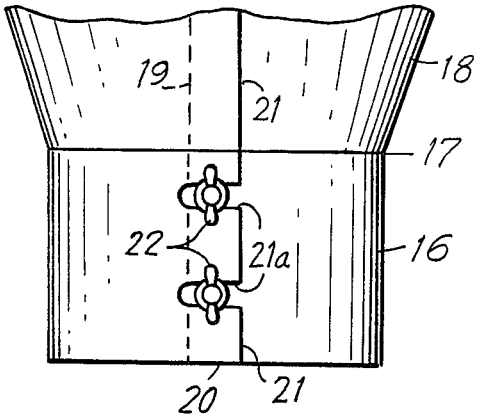
FIG. 5 shows an elevation view as seen from line 5—5' of FIG. 2.
Figure 6:
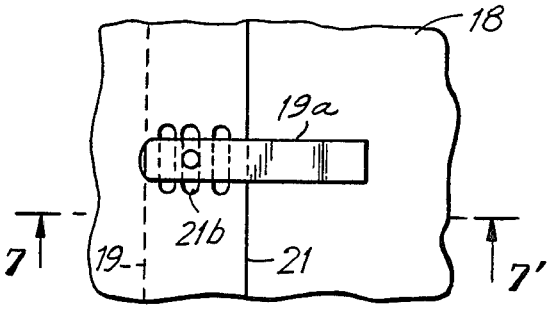
FIGS. 6–9 show alternative fastener means useful for the sleeve and casing portions of the retainer cup according to the invention.
Figure 7:
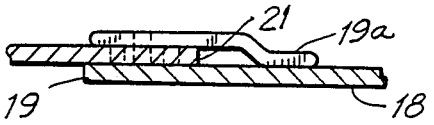
Figure 8:
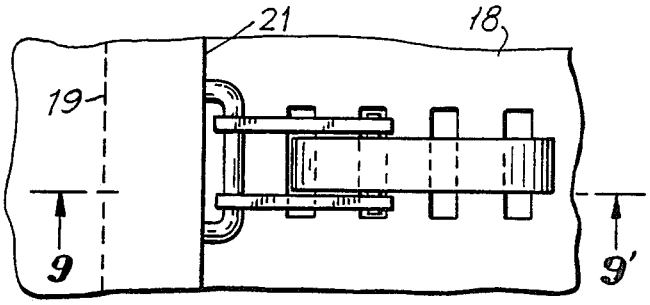
Figure 9:
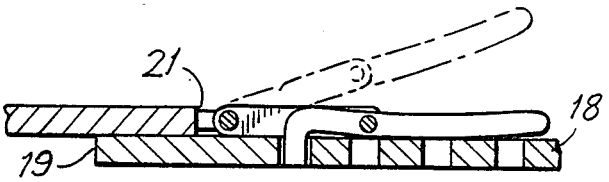

As is best shown by FIGS. 2–5, the cup 10 includes a lower cylindrical sleeve portion 16 and an upper conical shaped portion 18 which is sealably attached to the upper edge 17 of sleeve portion 16. The sleeve and conical portions of the cup structure have a longitudinally oriented joint 20 having mating edges 19 and 21, which permits the cup structure 10 to be sprung apart sufficiently for it to be installed around the continuous pipe 12. The mating edges 19 and 21 of the joint 20 are usually overlapped by 0.50–1.0 inch and are attached to each other by suitable fastener means 22, such as threaded clamps. The clamps may consist of one or more threaded bolts and wing type nuts attached adjacent one edge 19 of the longitudinal joint 20, and an equal number of elongated slots 21a provided in the overlapping mating edge 21 in alignment with the bolts, so that the overlapping edge 21 can be tightly clamped onto edge 19 by the threaded wing nuts. The mating edges of conical shaped casing portion 18 are retained together by a hook and eyelet 23 located near the casing upper end, as is shown by FIG. 4. Alternatively, the fastening means 22 can consist of one or more push type spring-loaded clamps attached to the outer side of the sleeve portion 16 and the conical portion 18, as generally shown by FIGS. 6–7. Another useful fastening means 22 can consist of one or more hinged over-center type clamps attached to the mating edges 19 and 21 of the sleeve 16 and conical portion 18, as generally shown by FIGS. 8–9. A drain opening 24 is provided in conical wall 18 near its lower end, and is closed by a removable plug 25 or similar closure means. A resilient layer 26 is provided attached within the cup sleeve portion 16 and is composed of a resilient material such as felt or foam rubber about 0.050–0.10 inch thick to accommodate any irregularities in the surface of the pipe 12. Layer 26 is preferably bonded onto the inner surface of sleeve portion 16 by an adhesive 27, such as household glue or rubber cement.

The cup sleeve and casing are made sufficiently thin and flexible so as to permit the cup to be sprung apart at the longitudinal joint 20 by a distance equal to the sleeve diameter, so that edges 19 and 21 of the cup can be slipped around pipe 12 and then clamped onto the pipe using clamps 22. Because of the clamping action provided by the sleeve portion 16 and its cylindrical shape, the sleeve portion is preferably made somewhat thicker than the conical portion, which relationship permits sufficient flexing of the cup sleeve and conical portions to permit the cup to be slipped around a pipe. The sleeve portion thickness is usually made about 1.0–1.25 times the thickness of the conical portion of the retainer cup.

Suitable material for the cup include waterproofed paper, moldable plastic such as polyethylene, or sheet metal such as aluminum or steel. The cup is usually made of aluminum sheet material having thickness of 0.015–0.025 inch.

The invention will be described further by reference to a typical example of a retainer cup, which should not be construed as limiting in scope.

EXAMPLE

A retainer cup was constructed having a conical shaped upper portion contiguously attached to a lower cylindrical sleeve portion as shown in FIG. 2. The cup was constructed of aluminum sheet material and has the following dimensions:

Cup overall length, in.: 7
Cup upper end diameter, in.: 7
Sleeve length, in.: 2
Sleeve inner diameter, in.: 3
Cup wall thickness, in.: 0.020
Drain opening diameter, in.: 0.50
Drain opening location above sleeve, in.: 1.0

The cup had a single longitudinal joint and a drain opening closed by a tapered plug. The sleeve portion was lined with a layer of felt material having a thickness of 0.060 inch. The felt layer was bonded onto the inner surface of the sleeve portion of the cup using household glue.

The cup was sprung apart at its longitudinal joint and was placed around a vertical pipe having 3 inch outside diameter. The cup was then moved upward so that the upper end of the conical portion was within 1 inch of the ceiling of a room. The cup accumulated dirt and grit material descending from a space above the room ceiling through a generally annular shaped opening about 1/16 to ⅛ inch wide around the pipe. After about 3-month service, the plug located near the lower end of the conical shaped portion was removed, and the accumulated material was removed from the cup by placing the hose end of a household vacuum cleaner over the opening and sucking out the material. After such cleaning, the plug was replaced in the cup opening.

What I claim is:

1. A retainer cup adapted for attachment around a continuous substantially vertical structure for retaining accumulated particulate material, the cup comprising:

a cylindrical shaped sleeve adapted for being attached around a continuous substantially vertical structure, said sleeve having a resilient material layer attached to its inner surface;

a conical-shaped casing having an enlarged diameter at its upper end and being joined at its lower end to said sleeve, said sleeve and casing having a single longitudinal joint having opposite mating edges thereof, said casing having a closable opening located at its lower end near said sleeve providing a means to drain the particulate material; and fastening means for attaching together said opposite mating edges of the sleeve and casing, so as to provide an unitary cup for retaining particulate material within the casing.

2. A retainer cup according to claim 1, wherein the resilient material layer attached within said cylindrical sleeve is 0.50–0.10 inch thick so as to contact uniformly the vertical structure outer surface.

3. A retainer cup according to claim 1, wherein said fastener means on the sleeve consist of at least two bolts and wing type nuts attached adjacent one edge of the longitudinal joint in said sleeve, which bolts fit into elongated slots provided in the opposite edge of the longitudinal joint and are clamped by the nuts, and said fastener means on the casing consists of a hook and eyelet attached to the opposite edges of the casing near the casing upper end.

4. A retainer cup according to claim 1, wherein the thickness of said sleeve is 1.0–1.25 times the thickness of said conical shaped casing.

5. A retainer cup according to claim 1, wherein said fastener means are push type spring loaded clamps attached to the outer side of said sleeve and conical-shaped casing.

6. A retainer cup according to claim 1, wherein said fastener means includes at least one hinged over-center type clamp attached to mating edges of said sleeve.

7. A retainer cup adapted for attachment around a continuous vertical pipe for retaining accumulated particulate matter therein, the cup comprising:

a cylindrical shaped sleeve adapted for being attached around a continuous vertical pipe, said sleeve having a resilient material layer 0.05–0.10 in. thick attached to its inner surface;

an upper conical shaped casing having an enlarged diameter at its upper end and being contiguously joined at its lower end to an edge of said sleeve, said sleeve and casing having a single longitudinal joint extending therealong and having opposite mating edges thereof, said casing having a closable opening located at its lower end near said sleeve providing a means to drain the particulate material, wherein said sleeve has a thickness of 1.0–1.25 times that of the casing; and fastening means for attaching together the opposite mating ends of said sleeve and casing after they are attached around a vertical pipe, so as to provide an unitary cup for retaining particulate material within said casing.

8. A retainer cup according to claim 1, wherein said opening is closed by a removable plug.

9. A retainer cup according to claim 2, wherein said sleeve is attached around a continuous substantially vertical pipe having angle of 0°–45° with the vertical and the casing upper end is substantially parallel with a ceiling surface.

10. A retainer cup unit attached around a continuous vertical structure for retaining accumulated particulate material in the cup, the unit comprising:

a cylindrical shaped sleeve attached around a continuous substantially vertical structure, said sleeve having a resilient material layer attached to its inner surface;

a conical-shaped casing having an enlarged diameter at its upper end and being joined at its lower end to said sleeve; said sleeve and casing having a single longitudinal joint having opposite mating edges thereof, said casing having a closable opening located at its lower end near said sleeve; and fastening means adapted for attaching together said opposite mating edges of the sleeve and casing, so as to provide a unitary cup unit fastened around said continuous vertical structure near a ceiling for retaining particulate material within the cup unit.

* * * * *